United States Patent [19]

Buyak et al.

[11] Patent Number: 4,929,924

[45] Date of Patent: May 29, 1990

[54] ELECTRONIC ALARM HORN

[75] Inventors: William P. Buyak, New Hartford; Bruce V. Testa, Cromwell; Robert W. Right, Huntington, all of Conn.

[73] Assignee: General Signal Corporation, Stamford, Conn.

[21] Appl. No.: 303,516

[22] Filed: Jan. 27, 1989

[51] Int. Cl.[5] ..... G08B 3/00

[52] U.S. Cl. ..... 340/384 E; 307/10.1; 331/107 R; 340/441

[58] Field of Search ..... 340/384 E, 384 R, 310 R, 340/326, 328, 331, 438, 288, 441, 815.22, 388, 692; 331/107 R; 116/137 R, 147; 307/10.1; 310/319

[56] References Cited

U.S. PATENT DOCUMENTS

| | | | |
|---|---|---|---|
| 3,707,716 | 12/1972 | Goralnick | 340/384 E |
| 4,083,037 | 4/1978 | Larsen | 340/237 |
| 4,246,572 | 1/1981 | Larsen | 340/501 |
| 4,274,084 | 6/1981 | Haus | 340/326 |
| 4,499,453 | 2/1985 | Right | 340/326 |
| 4,558,305 | 12/1985 | Black et al. | 340/384 E |
| 4,567,806 | 2/1986 | Kodaira | 340/384 E |
| 4,594,573 | 6/1986 | Yoshino et al. | 340/384 E |
| 4,689,609 | 8/1987 | Ko et al. | 340/384 E |
| 4,742,328 | 5/1988 | Arai et al. | 340/326 |
| 4,792,789 | 12/1988 | Matsumuro | 340/384 E |

*Primary Examiner*—Joseph A. Orsino
*Assistant Examiner*—Brent A. Swarthout
*Attorney, Agent, or Firm*—Robert R. Hubbard; William G. Miller

[57] ABSTRACT

In an electronic horn for alarm systems of the type in which an alarm condition is indicated by a reversal of polarity in the d.c. power supply, an improvement provides a pair of terminals for connection to said d.c. power supply, a series circuit including a current limiting element and a capacitor connected across said terminals, a speaker operable to produce sound in response to current flow through the speaker, the speaker being constructed so that it will reverberate for a period after the current flow through the speaker has stopped and switch means for connecting the speaker in parallel to said capacitor for the discharge of energy stored in the capacitor through the speaker when the switch means is in its conductive state with means for continuously cycling the switch means between its conductive and non-conductive states at a predetermined frequency and for a predetermined duration of "on" time for each switch cycle such that the sound produced by the pulses combines with that produced by reverberation of the speaker to provide a continuous tone as long as said pair of terminals is connected to the power source in the polarity indicative of an alarm condition.

6 Claims, 1 Drawing Sheet

ELECTRONIC ALARM HORN

BACKGROUND OF THE INVENTION

This invention relates to alarm devices such as are used in the fire protection industry. More particularly, it relates to alarm horns of the electronic type which are used to provide audio warnings and are frequently combined with strobe lights to provide an added visual warning such as might be needed to alert the hearing impaired.

There has developed a need to improve alarm horns and particularly to improve their efficiency. In that connection it is an object of this invention to provide a horn which has a more predictable sound output and a tone richer in harmonics and with substantial low frequency components in the 1 KHz region of the audio spectrum, where human hearing is the most sensitive. The low frequency components provide the additional benefit of being more effective in penetrating the walls of a building to provide the necessary alert for occupants located outside of the area where the alarm is placed.

In addition to the above objectives for performance, it is also an objective of the invention to provide a circuit design for electronic horns which will be useful in both 12 volt and 24 volt systems, which will be less likely to experience unpredictable line currents and which will make possible the easy changing of the sound level as well as the nature of the sound.

SUMMARY OF THE INVENTION

In an electronic horn for alarm systems of the type in which an alarm condition is indicated by a reversal of the polarity on the d.c. power supply, the present improvement provides a pair of terminals for connection to the d.c. power supply, a series circuit including a current limiting element and a capacitor connected across said terminals, a speaker operable to produce sound in response to current flow through the speaker, with the speaker being constructed to allow reverberation for a period after the current flow through the speaker has stopped, and switch means for connecting the speaker in parallel to the capacitor for discharge of the energy stored in the capacitor through the speaker when the switch means is in its conductive state with a means for continuously cycling the switch means between its conductive and non-conductive states so that the conductive period is a small percentage of each switch cycle and the cycle frequency is such that the speaker will continue to produce sound even after the switch becomes non-conductive due to the reverberant nature of the speaker.

BRIEF DESCRIPTION OF THE DRAWINGS

The sole FIGURE is a circuit diagram of a preferred form of the invention.

DESCRIPTION OF THE PREFERRED EMBODIMENTS

Figure 1:
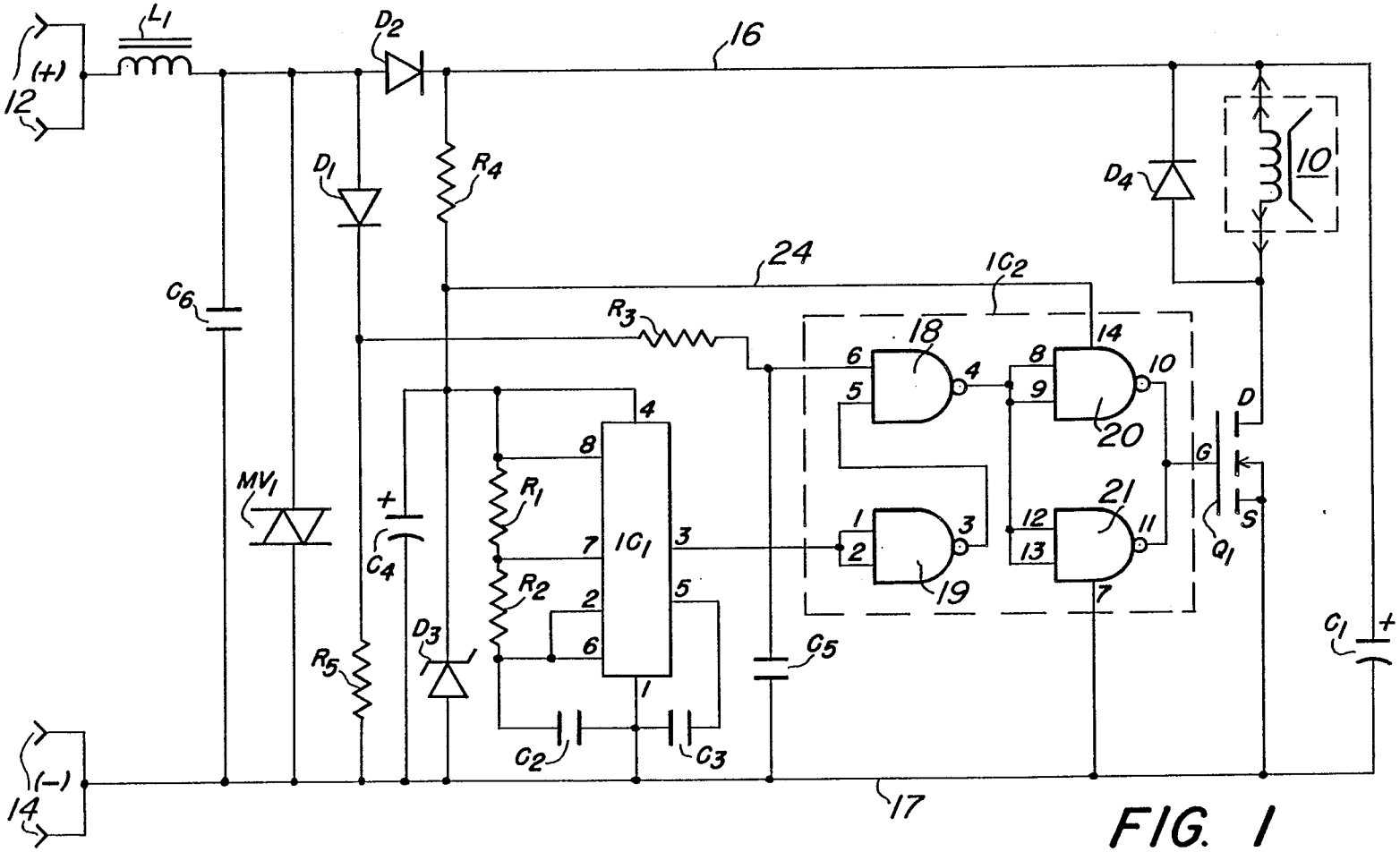

Referring to the sole FIGURE, it will be evident that the electrical drive for the speaker 10 is controlled by the integrated circuit $IC_1$, which is a pulse generator, and the switching action of switch $Q_1$, which is a voltage controlled switch.

The operating frequency and the pulse width of the electrical drive for the speaker is determined by resistors $R_1$ and $R_2$ in conjunction with the capacitor $C_2$.

These components can be readily changed or programmed to obtain different sound characteristics for the speaker output. It has been found to be advantageous to operate the oscillator at 200 Hz, for example. The capacitor $C_3$ is also associated with $IC_1$ to provide an electrical noise bypass for the pulse generator.

The switch $Q_1$ is shown as a power MOSFET which operates to switch short duration high current pulses to the speaker from the stored energy in capacitor $C_1$. By way of example, a pulse width, or switch "on" time, of less than 10%, preferably 1–6%, of the switch cycle has been found to be useful. The capacitor $C_1$ is recharged during the long off-periods of switch $Q_1$. Its charging circuit connects between the power supply terminals 12 and 14 and includes a current limiting element, such as the inductor $L_1$, and diode $D_2$. As a result, there is a moderate average current produced in the power lines (30 to 100 milliamps) even though the circuit operates to deliver on the order of 3.5 amperes to the speaker when switch $Q_1$ is conductive. Thus, the switching action of switch $Q_1$ is extremely efficient so that there is provided a high sound output level for the amount of power consumed by the circuit.

The actual horn sound is, of course, generated by the motion of the speaker's cone in response to current through its voice coil and the quality of the sound is a function of both the pulsed currents through the voice coil and the impulse response characteristics of the speaker assembly itself. The speaker assembly is designed so that its reverberant nature is effective to sustain the sound output between the pulses so that the sound output will be smoothed.

Another feature of the invention is to be found in the power line voltage sensing circuit. This circuit consists of an integrated circuit $IC_2$, which is made up of four NAND gates connected to drive the switch $Q_1$, a resistor $R_3$, a resistor $R_5$ and a capacitor $C_5$. The capacitor provides a voltage which is substantially at power line voltage and is effective to keep $IC_2$ operating for period, on the order of 10 milliseconds after discontinuities appear in the power supply voltage, before the horn becomes silent. This delayed cut-off by the horn provides for a short term continuation of its output not only during any short term losses of the power supply but also during short term depressions of the nominal supply voltage, such as might be experienced when the unit is powered from a full wave, rectified, unfiltered d.c. source of the type commonly provided by fire alarm control panels.

Since the voltage drop across $R_5$ is basically the supply voltage which appears across lines 16 and 17, the capacitor $C_5$ is normally kept charged to the supply voltage by charging current flowing through resistor $R_3$ whenever the voltage across $C_5$ decreases below the supply voltage. $C_5$ will thus maintain a high level, a logical 1, at terminal 6 of the NAND gate 18. With a logical 1 also on terminal 5 the output of gate 18 is a logical 0. Thus, a logical 0 is the input to both NAND gates 20 and 21 so that the output of 20 and 21 is a high level which will make switch $Q_1$ conductive between its drain and source. The switch will, therefore, be closed and conductive whenever the supply voltage is present at the same time that the oscillator pulse output from terminal 3 to $IC_1$ is present. A logical 0 output at terminal 3 of the oscillator will produce a logical 1 at the output of NAND gate 19 to provide the logical 1 input to terminal 5 of gate 18 needed to make the switch conductive. When the supply voltage falls, the charge on capacitor $C_5$ will hold the high level on terminal 6 of gate 18 for a short period until the charge dissipates below the threshold level needed to maintain the logical 0 output from gate 18. During that period the speaker will continue to produce sound because switch $Q_1$ will still be open. Once the level of the voltage across $C_5$ has dropped below that threshold the switch opens and the sound ceases. It will thus be seen that $IC_2$ is merely an AND gate which is effective to close the switch when there is present at the input of that circuit signals indicating the presence of adequate supply voltage along with the presence of an oscillator pulse.

The inductor $L_1$ provides an effective line disconnect during the short intervals that $Q_1$ is conductive. $L_1$ also provides input transient protection in combination with $C_6$ (the input electrical noise filter), $MV_1$ (the over-voltage protection) and $C_1$ (which provides additional capacity to absorb transients). The current limiting characteristics of $L_1$ can also be obtained by substituting some other type of current limiting element, such as a resistor, for $L_1$. The value of such a resistor could be on the order of 10 ohms, for example.

$MV_1$ is a metal oxide varistor (MOV) which provides over-voltage protection because it is generally non-conductive below 47 volts regardless of polarity and it is high conductive above 47 volts regardless of polarity.

The diodes $D_1$ and $D_2$ provide the diode disconnects required for four wire supervised installations. In such installations the polarity of the input terminals reverses whenever no alarm condition is present. When an alarm needs to be sounded those polarities are as shown in the FIGURE. It is, therefore, necessary to have the diode disconnects to prevent current from flowing in the circuit when there is no alarm condition.

The resistor $R_4$ in combination with diode $D_3$ and capacitor $C_4$ provide the regulated low voltage power supply necessary to operate $IC_1$ and $IC_2$, as supplied between lines 17 and 24. $R_4$ provides current limiting. $D_3$ provides a limit of the maximum voltage which will be applied to $IC_1$ and $IC_2$. $C_4$ provides smoothing, filtering and electrical energy storage.

The diode $D_4$ is effective to clamp any inductive energy stored in the voice coil so as to protect switch $Q_1$ from over-voltage inductive transients.

With this circuit the abrupt turn off provided by switch $Q_1$ saves the energy stored in the capacitor $C_1$ which is in turn instrumental in limiting large in-rush currents when power is reapplied to the circuit.

The circuit, as shown in the FIGURE and described above, provides a number of benefits. One benefit is the fact that it can be used on both 12 volt and 24 volt systems. A 12 volt system would use a 2 ohm speaker while a 24 volt system would use an 8 ohm speaker.

The circuit is also a cost effective means to produce an audible warning signal utilizing pulse-width control of transducer driving waveforms to allow output level control and operating current control by adjustment of the pulse-width while obtaining maximum operating efficiency regardless of the output level or the operating current.

The described technique drives the transducer with a low frequency component waveform for effective wall penetration and allowing the transducer to reverberate so as to generate higher frequency components for maximum human ear response.

Another benefit of this circuit is the incorporation of digital on/off control of the transducer waveform so that there is a time delay long enough to allow applied power to have valleys (lumpy d.c.) and not turn off the transducer waveform and still allow longer time periods to gate output waveforms.

Additionally, the incorporation of d.c. smoothing with an inductor-capacitor network causes the line currents to be at an average value of the high transducer peak currents.

The power line sensing circuit, consisting of $R_3$, $R_5$ and $C_5$, is useful in "March Time" operation, normally a $\frac{1}{4}$ second of horn tone followed by a $\frac{1}{4}$ second of silence because that type of operation would involve a lot of short term losses of power.

By way of example the circuit elements shown in the sole FIGURE may have the following values or identification number.

| element | value or No. |
|---|---|
| $L_1$ | 2.4 ohms, 178 microhenries |
| $C_1$ | 220 microfarads |
| $C_2$ | .01 microfarads |
| $C_3$ | .01 microfarads |
| $C_4$ | 4.7 microfarads |
| $C_5$ | 470 picofarads |
| $C_6$ | .01 microfarads |
| $R_1$ | 732 K |
| $R_2$ | 19.6 K |
| $R_3$ | 22 M |
| $R_4$ | 8.2 K |
| $R_5$ | 150 K |
| $IC_1$ | ICM7555 |
| $IC_2$ | CD4011BE |
| $D_1$ | 1N4004 |
| $D_2$ | 1N4004 |
| $D_3$ | 1N5236B |
| $D_4$ | 1N4934 |
| $Q_1$ | IRFD010 |

What is claimed is:

1. An electronic horn for alarm systems of the type in which an alarm condition is indicated by a reversal of polarity in the d.c. power supply for said horn, comprising:

a pair of terminals for connection to said d.c. power supply;

a series circuit including a current limiting element, a diode and a capacitor connected across said terminals and operable to charge said capacitor when the polarity of said d.c. supply appearing at said terminals is that which indicates an alarm condition;

a speaker operable to produce sound in response to current flow through said speaker, said speaker being constructed so that it will reverberate for a period after said current flow through said speaker has stopped;

switch means for connecting said speaker in parallel to said capacitor for the discharge of energy stored in said capacitor through said speaker when said switch means is in its conductive state; and means for continuously cycling said switch means between its conductive and non-conductive states at a predetermined frequency and with a predetermined percentage of "on" time for each cycle such that the sound produced by current pulses through said speaker resulting from said cycling combines with that produced by the reverberant characteristic of the speaker when the current pulses through the speaker are cut off to provide a continuous tone as long as said pair of terminals is connected to said power supply in the polarity indicative of an alarm condition.

2. An electronic horn as set forth in claim 1 in which said means for continuously cycling said switch means includes an oscillator for producing a pulse output having a predetermined frequency and a pulse width which is a small percentage of each cycle; and gate means operable to produce an output signal to said switch means which is effective to drive said switch to its conductive state upon the coincident appearance at the inputs to said gate of signals indicating the availability of power from said power source and an output pulse from said oscillator.

3. An electronic horn as set forth in claim 2 in which the predetermined frequency of the oscillator is determined by resistors and capacitor which can be easily changed to change said frequency.

4. An electronic horn as set forth in claim 1 in which said current limiting element is an inductor.

5. An electronic horn as set forth in claim 1 in which said percentage "on" time of the switch is less than 10%.

6. An electronic horn for alarm systems of the type in which an alarm condition is indicated by a reversal of polarity in the d.c. power supply for said horn, comprising:

a pair of terminals for connection to said d.c. power supply;

a series circuit including a current limiting element, a diode and a capacitor connected across said terminals and operable to charge said capacitor when the polarity of said d.c. supply appearing at said terminals is that which indicates an alarm condition;

a speaker operable to produce sound in response to current flow through said speaker, said speaker being constructed so that it will reverberate for a period after said current flow through said speaker has stopped;

switch means for connecting said speaker in parallel to said capacitor for the discharge of energy stored in said capacitor through said speaker when said switch means is in its conductive state;

means for continuously cycling said switch means between its conductive and non-conductive states at a predetermined frequency and with a predetermined percentage of "on" time for each cycle such that the sound produced by the current pulses through said speaker resulting from said cycling combines with that produced by the reverberant characteristic of the speaker when the current pulses through the speaker are cut off to provide a continuous tone as long as said pair of terminals is connected to said power supply in the polarity indicative of an alarm condition;

said means for continuously cycling said switch means including an oscillator for producing a pulse output having a predetermined freqency and a pulse width which is a small percentage of each cycle;

gate means operable to produce an output signal to said switch means which is effective to drive said switch to its conductive state upon the coincident appearance at the inputs to said gate of signals indicating the availability of power from said power source and an output pulse from said oscillator;

another series circuit formed by a resistor and another capacitor connected in series, said another series circuit being connected across said terminals so that as long as said power supply is providing power in the polarity indicating an alarm condition said another capacitor will be charged to substantially the same voltage as said supply; and means for connecting a junction between said another capacitor and said resistor to said gate so that the voltage across said another capacitor serves as the indication of the availability of power from said supply, whereby upon the occurrence of discontinuities in the availability of power in the alarm polarity the energy stored in said another capacitor will serve to maintain an output from said gate conincident with an output from said oscillator for brief periods after the occurrence of such a discontinuity.

* * * * *